US009561651B2

(12) United States Patent
Hatsui et al.

(10) Patent No.: US 9,561,651 B2
(45) Date of Patent: Feb. 7, 2017

(54) ELEMENT SUBSTRATE AND METHOD FOR DISCHARGING LIQUID

(71) Applicant: CANON KABUSHIKI KAISHA, Tokyo (JP)

(72) Inventors: Takuya Hatsui, Tokyo (JP); Souta Takeuchi, Fujisawa (JP); Kenji Takahashi, Yokohama (JP); Soichiro Nagamochi, Kawasaki (JP); Shinya Iwahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/050,879

(22) Filed: Feb. 23, 2016

(65) Prior Publication Data

US 2016/0263888 A1 Sep. 15, 2016

(30) Foreign Application Priority Data

Mar. 11, 2015 (JP) ..... 2015-048086

(51) Int. Cl.
*B41J 2/14* (2006.01)
*B41J 2/045* (2006.01)

(52) U.S. Cl.
CPC ..... *B41J 2/14088* (2013.01); *B41J 2/04501* (2013.01); *B41J 2/14016* (2013.01); *B41J 2/14112* (2013.01); *B41J 2/14129* (2013.01)

(58) Field of Classification Search
CPC . B41J 2/14088; B41J 2/14016; B41J 2/04501; B41J 2/14112; B41J 2/14129
See application file for complete search history.

(56) References Cited

U.S. PATENT DOCUMENTS

| | | | | |
|---|---|---|---|---|
| 6,361,150 | B1 | 3/2002 | Schulte et al. | |
| 2008/0129782 | A1 | 6/2008 | Kubo et al. | |
| 2014/0218439 | A1* | 8/2014 | Sakuma | B41J 29/17 347/30 |

FOREIGN PATENT DOCUMENTS

JP 2001-80073 A 3/2001

* cited by examiner

*Primary Examiner* — Geoffrey Mruk
(74) *Attorney, Agent, or Firm* — Fitzpatrick, Cella, Harper & Scinto

(57) ABSTRACT

An element substrate including a base having a heat-generating resistor element which generates thermal energy used for discharging a liquid; an electrically conductive protective layer covering the heat-generating resistor element; an insulating layer provided between the heat-generating resistor element and the protective layer; and a potential applying unit for applying a potential to the protective layer such that a potential of the protective layer is lower than a potential at one end of the heat-generating resistor element and higher than a potential at the other end of the heat-generating resistor element with a voltage being applied between the one end and the other end of the heat-generating resistor element.

14 Claims, 6 Drawing Sheets

ELEMENT SUBSTRATE AND METHOD FOR DISCHARGING LIQUID

BACKGROUND OF THE INVENTION

Field of the Invention

The present invention relates to an element substrate, which includes a heat-generating resistor element, and a method for discharging a liquid.

Description of the Related Art

Some liquid discharge recording apparatuses, such as an ink jet recording apparatus, employ an element substrate adapted to discharge a liquid by using a heat-generating resistor element. In this type of element substrate, a heat-generating resistor element may be subjected to a physical action, such as an impact caused by the cavitation in a liquid, or a chemical action caused by a liquid itself. For this reason, an element substrate is frequently provided with a protective layer for protecting the heat-generating resistor element from the foregoing actions.

Normally, the protective layer is deposited on the heat-generating resistor element, so that the protective layer is required to exhibit high heat resistance. Hence, the protective layer uses a metal, which has high heat resistance.

Further, in order to discharge a liquid by using a heat-generating resistor element, a voltage of a few volts to tens of volts needs to be applied to the heat-generating resistor element so as to bubble the liquid. In the case of the element substrate provided with the foregoing protective layer, a potential difference occurs between the protective layer and the liquid upon the application of the voltage to the heat-generating resistor element. If the potential difference exceeds a certain level, then the metal constituting the protective layer and the liquid may react with each other, causing the metal to be anodically oxidized or the metal to be dissolved into the liquid. As a solution, Japanese Patent Application Laid-Open No. 2001-080073 discloses a configuration in which an insulating layer is provided between a heat-generating resistor element and a protective layer.

In recent years, with increasing trend toward higher accuracy and higher speed in printing, liquid discharge apparatuses have been required to promptly discharge as much liquid as possible while minimizing the amount of liquid discharged at a time from each discharge port. Therefore, liquid discharge apparatuses have been developed to have a greater number of discharge ports and heat-generating resistor elements and to achieve a higher density thereof.

However, the heat generated by a heat-generating resistor element is transferred to a substrate, so that densely disposing many heat-generating resistor elements tends to cause the temperature of the substrate to rise. If the temperature of the substrate exceeds a certain level, then the discharge of the liquid may be adversely affected, which is typically represented by unstable bubbling of the liquid. If this happens, the printing must be interrupted until the temperature of the substrate decreases, resulting in printing slowdown.

Thus, it is required to transmit the heat generated by the heat-generating resistor elements to the liquid as efficiently as possible to suppress the temperature rise in the substrate. Making the insulating layer thinner allows the heat to be transmitted to the liquid more efficiently. However, making the insulating layer thinner may undesirably deteriorate the insulation properties thereof, resulting in a failure to obtain adequate insulation properties.

The present invention has been made with a view of the problem described above, and an object of the invention is to provide an element substrate capable of securing insulation properties while using a thinner insulating layer, and a liquid discharge head provided with the element substrate.

SUMMARY OF THE INVENTION

According to an embodiment of the present invention, there is provided an element substrate including a base having a heat-generating resistor element which generates thermal energy used for discharging a liquid; an electrically conductive protective layer covering the heat-generating resistor element; and an insulating layer provided between the heat-generating resistor element and the protective layer, the element substrate further including a potential applying unit for applying a potential to the protective layer such that a potential of the protective layer is lower than a potential at one end of the heat-generating resistor element and higher than a potential at the other end of the heat-generating resistor element with a voltage being applied between the one end and the other end of the heat-generating resistor element. According to another embodiment of the present invention, there is provided an element substrate including a base having a heat-generating resistor element which generates thermal energy used for discharging a liquid; an electrically conductive protective layer covering the heat-generating resistor element; and an insulating layer provided between the heat-generating resistor element and the protective layer, the element substrate further including a wiring which is connected to the protective layer and which causes a potential of the protective layer to take a value between a maximum potential and a minimum potential in the heat-generating resistor element with a voltage being applied to the heat-generating resistor element to discharge a liquid.

According to still another embodiment of the present invention, there is provided a method for discharging a liquid in a liquid discharge head including an element substrate which comprises a heat-generating resistor element which generates thermal energy used for discharging a liquid, an electrically conductive protective layer covering the heat-generating resistor element, and an insulating layer provided between the heat-generating resistor element and the protective layer, the method including applying a potential to the protective layer such that the potential of the protective layer is lower than a potential at one end of the heat-generating resistor element and higher than a potential at the other end of the heat-generating resistor element with a voltage being applied between the one end and the other end of the heat-generating resistor element in order to discharge a liquid.

According to the invention described above, the potential of a protective layer when a heat-generating resistor element generates heat takes a value between the potentials at both ends of the heat-generating resistor element, thus making it possible to reduce a voltage to be applied to an insulating layer between the heat-generating resistor element and the protective layer.

Therefore, the present invention allows the use of a thinner insulating layer while securing insulation properties.

Further features of the present invention will become apparent from the following description of exemplary embodiments with reference to the attached drawings.

DESCRIPTION OF THE EMBODIMENTS

Figure 1A:
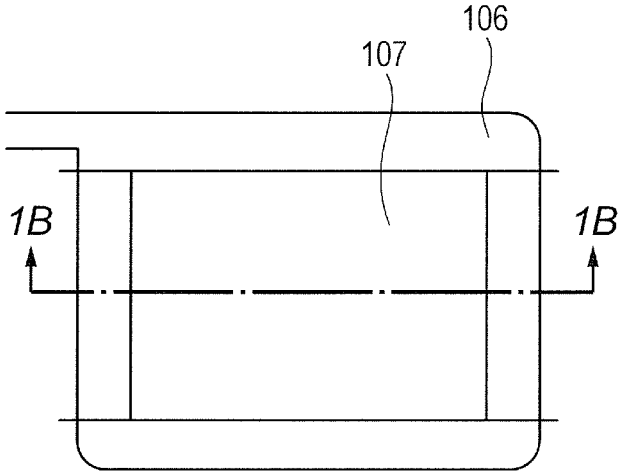
FIG. 1A and FIG. 1B are drawings illustrating an element substrate according to a first embodiment of the present invention.

Preferred embodiments of the present invention will now be described in detail in accordance with the accompanying drawings. In the following description, components having the same functions may be assigned the same reference numerals, and the descriptions thereof may be omitted.

First Embodiment

Figure 1B:
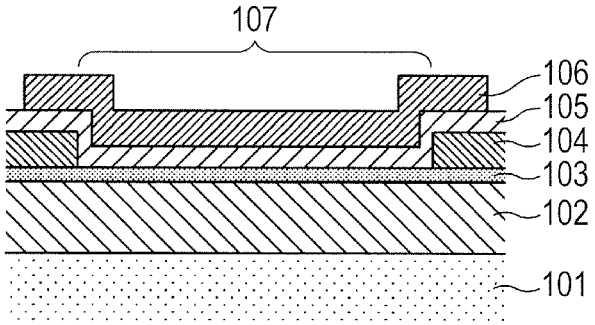
Figure 6A:
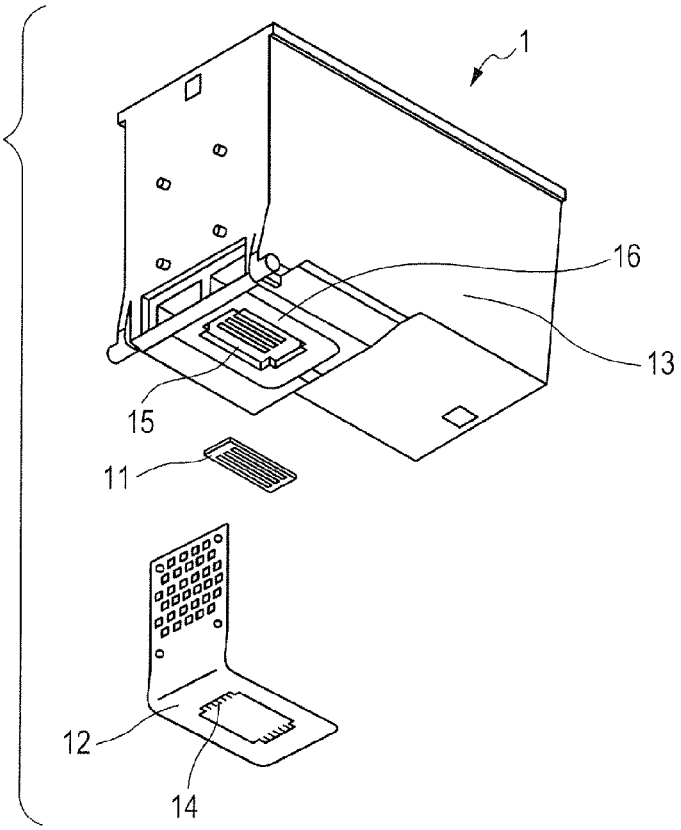
FIG. 6A and FIG. 6B are drawings illustrating a liquid discharge head according to a fifth embodiment of the present invention.
Figure 6B:
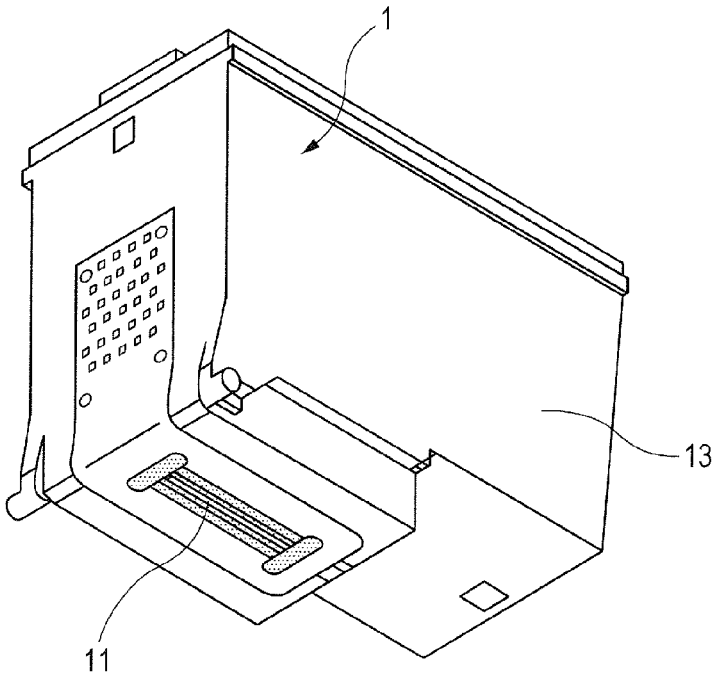

FIG. 1A and FIG. 1B illustrate the neighborhood of a heat-generating resistor element 107 which generates thermal energy used for discharging a liquid and which is a part of an element substrate according to a first embodiment of the present invention. More specifically, FIG. 1A is a plan view illustrating the part of the element substrate according to the present embodiment, and FIG. 1B is a sectional view taken along a cutting-plane line 1B-1B of the element substrate illustrated in FIG. 1A. As illustrated in FIG. 6A and FIG. 6B, an element substrate 11 has a rectangular shape. The element substrate 11 is provided with a plurality of discharge ports through which a liquid is discharged and a plurality of the heat-generating resistor elements 107 corresponding to the discharge ports.

As illustrated in FIG. 1A and FIG. 1B, the element substrate of the present embodiment is an element substrate for discharging a liquid, such as an ink, and has a base 101, a heat reserve layer 102, a heat-generating resistor layer 103, an electrode wiring layer 104, an insulating layer 105, and a protective layer 106.

The base 101 is formed of Si. The base 101 is provided with the heat reserve layer 102 for reserving heat. The heat reserve layer 102 is formed of a thermally oxidized film, a SiO film, or a SiN film. The heat-generating resistor layer 103 is deposited on the heat reserve layer 102. The heat-generating resistor layer 103 is formed of TaSiN or the like.

Provided on the heat-generating resistor layer 103 is the electrode wiring layer 104, which functions as an electrode for applying a voltage to the heat-generating resistor layer 103. The electrode wiring layer 104 is formed of a metal material, such as Al, Al—Si or Al—Cu. The electrode wiring layer 104 is connected to a drive circuit or a power source wiring (not illustrated), through which power is supplied from the outside.

A part of the electrode wiring layer 104 is removed thereby to form a cavity, and the region of the heat-generating resistor layer 103 at the location where the cavity has been formed is provided as the heat-generating resistor element 107, which generates the thermal energy used for heating and discharging a liquid. More specifically, the electrode wiring layer 104 has a first and a second electrode wirings, which are provided with a predetermined interval therebetween. In the heat-generating resistor layer 103, the region between the paired electrode wiring layers 104, that is, the first and the second electrode wirings, provides the part that functions as the heat-generating resistor element 107. According to the configuration illustrated in FIG. 1A and FIG. 1B, the electrode wiring layer 104 is disposed on the heat-generating resistor layer 103. Alternatively, however, the heat-generating resistor layer 103 may be disposed on the electrode wiring layer 104. In this case, the electrode wiring layer 104 is disposed on the base 101 or the heat reserve layer 102, and a part of the electrode wiring layer 104 is removed to form a cavity. Then, the heat-generating resistor layer 103 is formed on the electrode wiring layer 104, in which the cavity has been formed. At this time, the region of the heat-generating resistor layer 103 that has been formed over the cavity provides the heat-generating resistor element.

The insulating layer 105, which has insulation properties, is provided over the heat-generating resistor layer 103 and the electrode wiring layer 104 such that the insulating layer 105 covers the heat-generating resistor layer 103. The insulating layer 105 is formed of, for example, a SiO film or a SiN film.

Provided on the insulating layer 105 to cover the insulating layer 105 is the protective layer 106, which protects the heat-generating resistor element 107 from a physical action, such as an impact attributable to the cavitation of a liquid, or a chemical action of a liquid itself. The protective layer 106 is electrically conductive, and formed of such a material as Ta or as a platinum group such as Ir and Ru, which exhibits high resistance to chemical actions.

In the present embodiment, a voltage is applied to the protective layer 106 according to the timing at which a voltage is applied to the heat-generating resistor element 107 to discharge an ink. This voltage permits a reduction in the voltage applied to the insulating layer 105. Hence, the insulating layer 105 can be made thinner while securing the insulation properties, thus making it possible to efficiently transmit the heat generated by the heat-generating resistor element 107 to the liquid.

More specifically, the voltage to be applied to the protective layer 106 is set such that the potential of the protective layer 106 upon application of the voltage to the protective layer 106 takes a value between the potentials at both ends of the heat-generating resistor element 107 to which the voltage is being applied to discharge the ink. In other words, the voltage is applied to the protective layer 106 such that the potential of the protective layer 106 is larger than the potential at one end of the heat-generating resistor element 107 and smaller than the potential at the other end thereof. The potentials at both ends of the heat-generating resistor element 107 are the potential at one end of the region between the first and the second electrode wirings, the one end being on the side of the first electrode wiring, and the potential at the other end of the region, the other end being on the side of the second electrode wiring.

The specific configuration of a potential applying unit for applying the potential of the foregoing value to the protective layer 106 will be described in the embodiments, which will be discussed hereinafter. However, the present invention is not limited to the configurations in the embodiments to be discussed hereinafter. This means that other configurations may be adopted insofar as the voltage is applied to the protective layer 106 such that the potential of the protective layer 106 becomes a potential between both ends of the heat-generating resistor element 107 as described above.

Further, the duration in which the voltage is applied to the protective layer 106 is preferably controlled to 1 ms or less in order to suppress the occurrence of the anodic oxidation in the protective layer 106. More preferably, the duration is approximately the duration in which the heat-generating resistor element 107 generates heat, i.e. the duration in which the voltage is applied to the heat-generating resistor element 107.

The time for which a liquid is heated by the application of the voltage to the heat-generating resistor element 107 is normally 10 μs or less or a few microseconds or less for each heating. Meanwhile, after the voltage is applied to the protective layer 106, it takes a few milliseconds until an electrochemical reaction takes place in the protective layer 106 to start the anodic oxidation of the protective layer 106. Therefore, controlling the duration of the application of the voltage to the protective layer 106 to 1 ms or less makes it possible to suppress the occurrence of the anodic oxidation. More preferably, setting the duration of the application of the voltage to the protective layer 106 to be equal to the duration of the application of the voltage to the heat-generating resistor element 107 makes it possible to reduce the voltage applied to the insulating layer 105 while suppressing the anodic oxidation of the protective layer 106.

A variety of circuits may be formed on the base 101 by a semiconductor process, and the heat reserve layer 102 may be formed in the process of fabricating the circuits. Further, the configuration of a circuit on the base 101 (e.g. number of the wiring layers), and the configuration, the shape and the like of the heat-generating resistor element 107 may be set as appropriate.

Second Embodiment

Figure 2A:
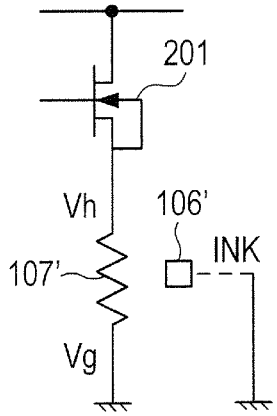
FIG. 2A, FIG. 2B and FIG. 2C are drawings for explaining an element substrate according to a comparative example.
Figure 2B:
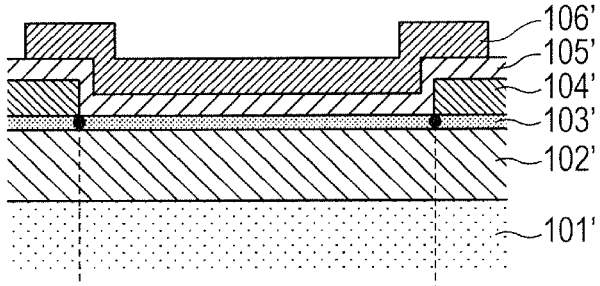
Figure 2C:
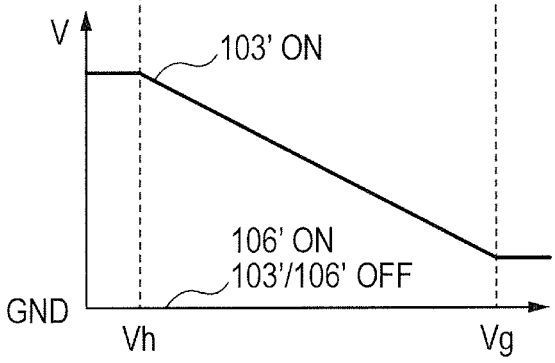

First, a comparative example will be described to clearly indicate the difference between the present embodiment and the comparative example. FIG. 2A to FIG. 2C are drawings for explaining an element substrate according to the comparative example.

FIG. 2A is a circuit diagram of a circuit that includes a heat-generating resistor element 107' as the comparative example. As illustrated in FIG. 2A, one end of the heat-generating resistor element 107' is grounded, and the other end of the heat-generating resistor element 107' is connected to a driver 201.

The driver 201 controls the supply of current to the heat-generating resistor element 107'. More specifically, in an ON state, in which the driver 201 operates, the current is supplied to the heat-generating resistor element 107'. In an OFF state, in which the driver 201 is at rest, the current is not supplied to the heat-generating resistor element 107'.

FIG. 2B is a sectional view of an element substrate of the comparative example. As illustrated in FIG. 2B, the element substrate of the comparative example has a heat reserve layer 102', a heat-generating resistor layer 103', an electrode wiring layer 104', an insulating layer 105' and a protective layer 106', which are deposited in this order on a base 101'. At a glance, the protective layer 106' seems to be not grounded, as illustrated in FIG. 2A. Actually, however, the protective layer 106' is grounded through the intermediary of a liquid on the protective layer 106'.

FIG. 2C illustrates the potentials of the heat-generating resistor layer 103' and the protective layer 106' when the driver 201 is in the ON state and in the OFF state.

When the driver 201 is in the OFF state, the potentials of the heat-generating resistor layer 103' and the protective layer 106' become a ground potential GND, as indicated by a line "103'/106'OFF," since no current flows into the heat-generating resistor element 107'. Meanwhile, if the driver 201 is in the ON state, then the potential of the heat-generating resistor layer 103' decreases from a positive electrode side toward a negative electrode side of the heat-generating resistor element 107', as indicated by a line "103'ON." More specifically, an electrode potential Vh of the heat-generating resistor layer 103' on the positive electrode side of the heat-generating resistor element 107' increases close to a power source potential, whereas an electrode potential Vg of the heat-generating resistor layer 103' on the negative electrode side of the heat-generating resistor element 107' hardly changes from that in the OFF state. The potential of the protective layer 106' remains to be the ground potential GND in both the ON state and the OFF state, as indicated by a line "106'ON." Thus, the maximum value of the voltage applied to the insulating layer 105' will be determined by subtracting the ground potential GND from the electrode potential Vh.

FIG. 3A to FIG. 3D are diagrams for explaining the element substrate according to the present embodiment.

Figure 3A:
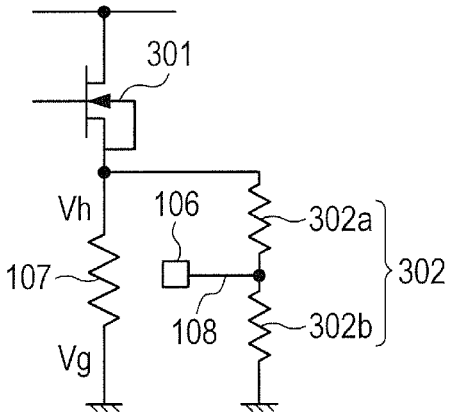
FIG. 3A, FIG. 3B, FIG. 3C and FIG. 3D are drawings for explaining an element substrate according to a second embodiment of the present invention.

FIG. 3A is a circuit diagram of the circuit that includes a heat-generating resistor element 107 of the present embodiment. Referring to FIG. 3A, one end of the heat-generating resistor element 107 is grounded, while the other end of the heat-generating resistor element 107 is connected to a driver 301. The driver 301 is a drive circuit that controls the supply of current flowing into a protective layer 106 and the heat-generating resistor element 107.

In the example illustrated in FIG. 3A, the driver 301 is composed of an nMOS transistor. The drain of the nMOS transistor is connected to ground wiring through the intermediary of the heat-generating resistor element 107, and the source thereof is connected to a power source wiring to which power is supplied from an external source. Thus, the MOS transistor constituting the driver 301, the heat-generating resistor element 107 and the ground wiring are connected in series in this order to the power source wiring. If the driver 301 is in the ON state, i.e. when the gate is at a high level, then current is supplied to the heat-generating resistor element 107. If the driver is in the OFF state, i.e. if the gate is at a low level, then the current is not supplied to the heat-generating resistor element 107.

Further, according to the present embodiment illustrated in FIG. 3A, unlike the comparative example illustrated in FIG. 2A, the wiring is branched between the heat-generating resistor element 107 and the driver 301, and grounded through the intermediary of a voltage-dividing resistor 302. The voltage-dividing resistor 302 is an example of a generation circuit (a potential applying unit) that generates the potential of a protective layer 106. The voltage-dividing resistor 302 has a configuration in which voltage-dividing resistors 302*a* and 302*b* are connected in series, and is connected to the protective layer 106 through the intermediary of a connection wiring 108 branched between the voltage-dividing resistors 302*a* and 302*b*. Thus, the connection wiring 108 branched between the MOS transistor, which is the driver 301, and the heat-generating resistor element 107 is connected to the protective layer 106 through the intermediary of the voltage-dividing resistor 302.

Figure 3B:
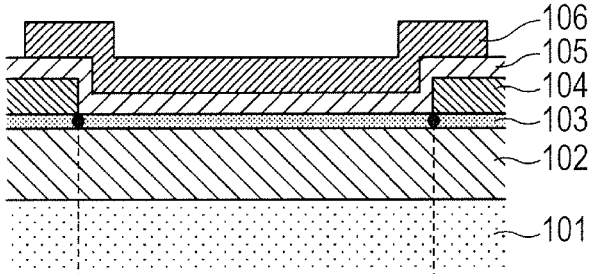
Figure 3C:
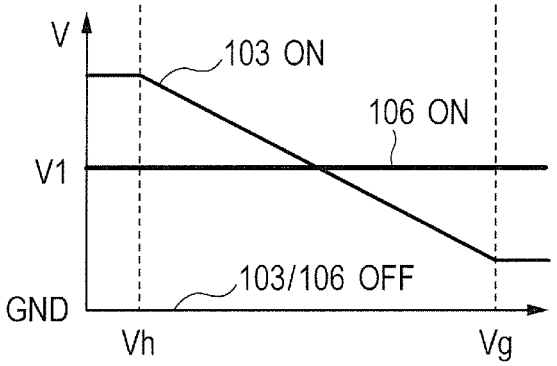

FIG. 3B and FIG. 3C illustrate the potentials of the heat-generating resistor layer 103 and the protective layer 106 when the driver 301 is in the ON state and in the OFF state.

If the driver 301 is in the OFF state, then the potentials of the heat-generating resistor layer 103 and the protective layer 106 will be the ground potential GND, as indicated by a line "103/106OFF," since no current passes through the heat-generating resistor element 107 and the voltage-dividing resistor 302.

Meanwhile, if the driver 301 is in the ON state, then the potential of the heat-generating resistor layer 103 decreases from a positive electrode side toward a negative electrode side of the heat-generating resistor element 107, as indicated by a line "103ON." More specifically, an electrode potential Vh of the heat-generating resistor layer 103 on the positive electrode side of the heat-generating resistor element 107 increases close to the power source potential, whereas an electrode potential Vg of the heat-generating resistor layer 103 on the negative electrode side of the heat-generating resistor element 107 hardly changes from that in the OFF state. The potential of the protective layer 106 will be a potential V1 based on the ratio between the resistance value of the voltage-dividing resistor 302*a* and the resistance value of the voltage-dividing resistor 302*b*, as indicated by a line "106ON." At this time, the maximum value of the voltage applied to the insulating layer 105 will be Vh−V1 or V1−Vg, whichever is greater, and will be smaller than that in the comparative example in either case. Thus, when heating the heat-generating resistor element 107 by applying the voltage thereto, the voltage is applied to the insulating layer 105 such that the potential will take a value between the maximum potential (Vh) and the minimum potential (Vg).

The dielectric strength voltage of the insulating layer 105 increases in proportion to the film thickness thereof. In the present embodiment, the maximum value of the voltage applied to the insulating layer 105 is smaller than that in the comparative example. This makes it possible to maintain the insulation properties even if the film thickness of the insulating layer is decreased to reduce the dielectric strength voltage of the insulating layer 105. Therefore, the film thickness of the insulating layer can be decreased, thus permitting efficient transmission of the heat generated by the heat-generating resistor element 107 to the liquid. In addition, the heat transmitted to the base 101 can be reduced, so that the adverse effect caused by a rise in the temperature of the base 101 can be reduced.

Further, when a large amount of current flowing through the voltage-dividing resistor 302, increased fluctuations are caused in the electrode potential Vh. Hence, the voltage-dividing resistor 302 preferably has a resistance value that is larger than the resistance value of the heat-generating resistor element 107, and more preferably has a resistance value that is a hundred or more times the resistance value of the heat-generating resistor element 107. Further, the resistance values of the voltage-dividing resistor 302*a* and the voltage-dividing resistor 302*b* are desirably the same.

Normally, in order to discharge a liquid by using the element substrate described above, the heat-generating resistor element 107 is caused to rapidly generate heat in a short time so as to form bubbles in a liquid by utilizing film boiling. For this purpose, the driver 301 operates such that a pulse voltage is applied to the heat-generating resistor element 107.

The width of the pulse voltage is preferably 10 μs or less and more preferably 3 μs or less. Further, the height of the pulse voltage preferably ranges from 10V to 50V, and more preferably ranges from 20V to 35V. At this time, the potential of the protective layer 106 when the driver 301 is in the ON state, i.e. the potential of the protective layer 106 upon heat generation of the heat-generating resistor element 107, preferably takes a value between the potentials Vh and Vg at both ends of the heat-generating resistor element 107. Further preferably, the potential of the protective layer 106 upon heat generation of the heat-generating resistor element 107 takes a value within the range of ±10% of the mean value (mean potential) of the electrode potentials Vh and Vg. If the film thickness of the insulating layer 105 is too small, then a failure, such as a pinhole formed in the insulating layer 105, may occur. For this reason, the film thickness of the insulating layer 105 preferably ranges from approximately 5 nm to approximately 500 nm, more preferably ranges from 10 nm to 300 nm, and further more preferably ranges from 10 nm to 200 nm.

Figure 3D:
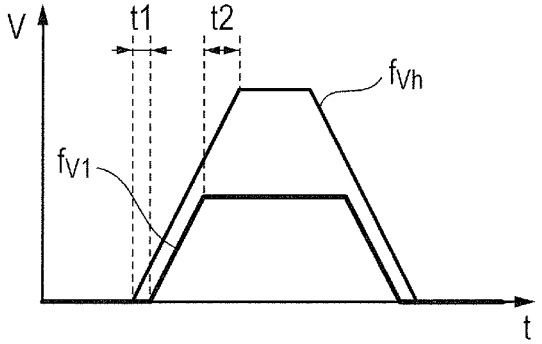

FIG. 3D illustrates a temporal change $f_{vh}$ of the electrode potential Vh of the heat-generating resistor element 107 and a temporal change $f_{v1}$ of the potential V1 of the protective layer 106 when the pulse voltage is applied to the heat-generating resistor element 107.

The potential difference between the electrode potential Vh of the heat-generating resistor element 107 and the potential V1 of the protective layer 106 becomes the voltage applied to the insulating layer 105. Hence, an arrangement has to be taken such that the potential difference is kept to be the dielectric strength voltage of the insulating layer 105 or less at all times.

Time t1 from the rising start time of the electrode potential Vh to the rising start time of the potential V1, and time t2 from the maximum voltage arrival time of the potential V1 to the maximum voltage arrival time of the electrode potential Vh to the maximum voltage are both preferably zero or more. In other words, the electrode potential Vh is preferably at the same time of or earlier than the rising start time of the potential V1. Further, the maximum voltage arrival time of potential V1 is preferably at the same time of or earlier than the maximum voltage arrival time of the electrode potential Vh.

According to the present embodiment described above, the driver 301 is composed of the nMOS transistor, the drain thereof being grounded through the intermediary of the heat-generating resistor element 107. Although the configuration is preferable, the present invention is not limited to the configuration. For example, the driver 301 may be composed of a pMOS transistor with the source thereof grounded.

Third Embodiment

FIG. 4A to FIG. 4E are diagrams for explaining an element substrate according to a third embodiment of the present invention.

Figure 4A:
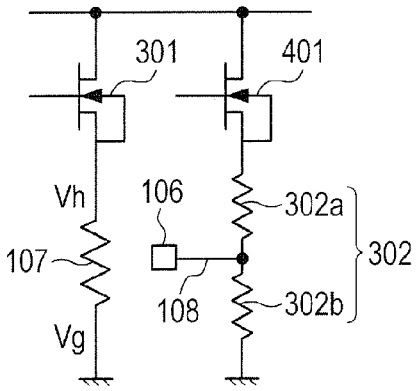
FIG. 4A, FIG. 4B, FIG. 4C, FIG. 4D and FIG. 4E are drawings for explaining an element substrate according to a third embodiment of the present invention.

FIG. 4A is the circuit diagram of a circuit that includes a heat-generating resistor element 107 according to the present embodiment. As illustrated in FIG. 4A, the element substrate of the present embodiment has, as a drive circuit, a protective layer driver 401, in addition to a driver 301. In the present embodiment, the driver 301 controls the supply of current to the heat-generating resistor element 107, while the protective layer driver 401 controls the supply of current to the protective layer 106.

In the example illustrated in FIG. 4A, one end of the protective layer driver 401 is connected to a power source wiring not via the driver 301, and the other end thereof is grounded through the intermediary of a voltage-dividing resistor 302. The protective layer driver 401 is independent of the driver 301, so that the condition of the protective layer driver 401 does not influence the voltage of the heat-generating resistor element 107. This enables the protective layer driver 401 to freely set the potential of the voltage-dividing resistor 302. Further, the voltage to be applied to an insulating layer 105 can be controlled by adjusting the timing at which the protective layer driver 401 is driven. According to the present embodiment, the protective layer driver 401 is composed of an nMOS transistor. The drain of the nMOS transistor is connected to a ground wiring through the intermediary of the voltage-dividing resistor 302, and the source thereof is connected to the power source wiring. Hence, the MOS transistor constituting the protective layer driver 401, the voltage-dividing resistor 302, and the ground wiring are connected in series in this order to the power source wiring. Alternatively, the protective layer driver 401 may be composed of a pMOS transistor and the source thereof may be grounded. If the protective layer driver 401 is in an ON state, i.e. if the gate is at a high level, then current is supplied to the protective layer 106. If the protective layer driver 401 is in an OFF state, i.e. if the gate is at a low level, then current is not supplied to the protective layer 106.

Figure 4B:
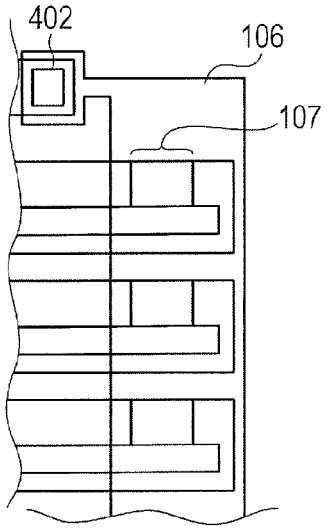
Figure 4C:
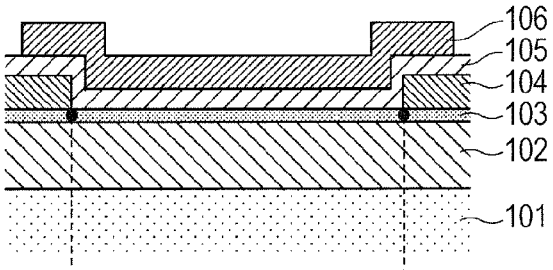
Figure 4D:
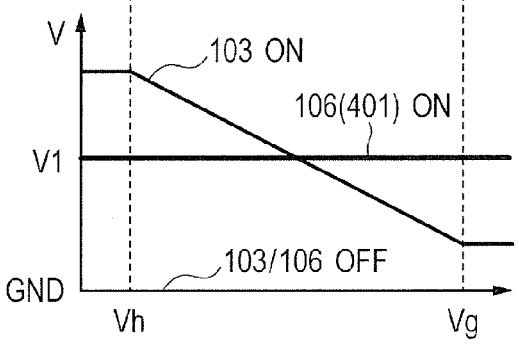

FIG. 4B is a plan view of the heat-generating resistor element 107 of the present embodiment. As illustrated in FIG. 4B, a plurality of the heat-generating resistor elements 107 share the same insulating layer 105 and the same protective layer 106. The protective layer 106 is connected to the single protective layer driver 401 by using a through hole 402. This makes it possible to simultaneously change the voltage of the protective layer 106 of the plurality of the heat-generating resistor elements 107. Therefore, the quantity of the voltage-dividing resistors 302 can be reduced, thus making it possible to significantly reduce the current consumed by the entire element substrate. Further, the area for forming the voltage-dividing resistors 302 can be reduced, thus permitting a reduced size of the element substrate.

At this time, the plurality of the heat-generating resistor elements 107 corresponding to the protective layer 106 connected to the single protective layer driver 401 do not always operate at the same time. If the driver 301 of the heat-generating resistor element 107 is in the ON state, then the potential of the heat-generating resistor layer 103 of the heat-generating resistor element 107 is denoted by a line "103ON" in FIG. 4D. Meanwhile, if the driver 301 of the heat-generating resistor element 107 is in the OFF state, then the potential of the heat-generating resistor layer 103 of the heat-generating resistor element 107 is denoted by a line "103/106OFF." Even if there are heat-generating resistor elements 107 corresponding to these two states among the foregoing plurality of the heat-generating resistor elements 107, the voltage applied to the insulating layer 105 can be considerably reduced from that in the comparative example insofar as the potential of the protective layer 106 lies between the electrode potentials Vh and Vg.

Figure 4E:
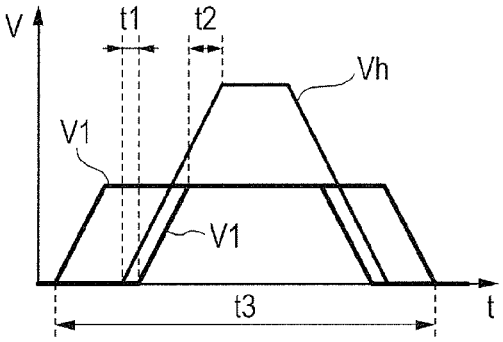

As in FIG. 3D, FIG. 4E illustrates the temporal changes in the electrode potential Vh of the heat-generating resistor element 107 and a potential V1 of the protective layer 106 when a pulse voltage is applied to the heat-generating resistor element 107. As in the above-mentioned embodiment, the time t1 from the rising start time of the electrode potential Vh to the rising start time of the instant the potential V1, and the time t2 from the maximum voltage arrival time of the potential V1 to the maximum voltage arrival time of the electrode potential Vh are both preferably zero or more.

Further, according to the present embodiment, the potential V1 of the protective layer 106 is controlled independently of the electrode potential Vh of the heat-generating resistor element 107, so that a pulse width t3 of the pulse voltage applied to the protective layer 106 can be prolonged. However, a greater pulse width t3 means a longer time of the application of the voltage to the protective layer 106, and therefore, the anodic oxidation of the protective layer 106 may proceed. Hence, the pulse width t3 is preferably 100 μs or less and more preferably ranges from 2 μs to 5 μs.

Further, according to the present embodiment, changing the voltage applied to the protective layer 106 and the method of applying the voltage makes it possible to intentionally cause a burnt deposit on the protective layer 106 to be eluted. In this case, an electrode for applying a negative potential to the protective layer 106 is preferably provided in addition to the electrode for applying the foregoing pulse voltage so as to permit smoother flow of current into the protective layer 106.

Fourth Embodiment

Figure 5A:
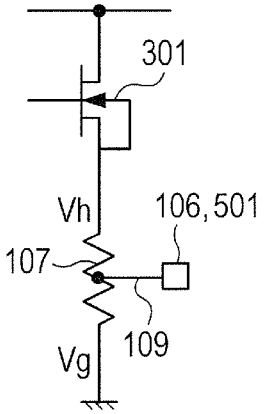
FIG. 5A, FIG. 5B and FIG. 5C are drawings for explaining an element substrate according to a fourth embodiment of the present invention.
Figure 5B:
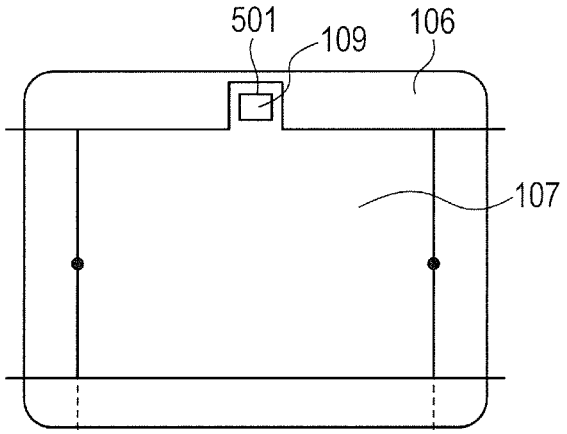
Figure 5C:
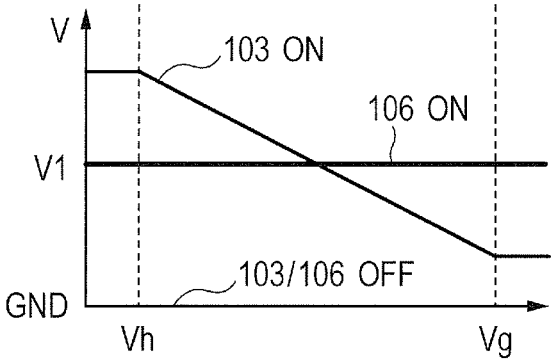

FIG. 5A to FIG. 5C are diagrams for explaining an element substrate according to a fourth embodiment of the present invention.

FIG. 5A is a circuit diagram of a circuit that includes a heat-generating resistor element 107 of the present embodiment. As illustrated in FIG. 5A, according to the present embodiment, a connection wiring 108 branched from the heat-generating resistor element 107 is connected to a protective layer 106, so that a voltage to be applied to the protective layer 106 is directly taken from the heat-generating resistor element 107. At this time, the connection wiring 108 functions as a generation circuit (i.e. a potential applying unit), which generates a potential of the protective layer 106.

FIG. 5B is a plan view of the heat-generating resistor element 107 of the present embodiment. As illustrated in FIG. 5B, the connection wiring 108 is formed using a heat-generating resistor layer 103 between the heat-generating resistor elements 107, and a through hole 501 is formed in an insulating layer 105 to connect the connection wiring 108 with the protective layer 106. In this case, the potentials of the heat-generating resistor layer 103 and the protective layer 106 are the same as those in the second embodiment, as illustrated in FIG. 5C.

According to the present embodiment, there is no need to provide a voltage-dividing resistor 302 for generating a potential to be applied to the protective layer 106. Hence, even if a thinner insulating layer is used, adequate insulation properties can be obtained by a simple circuit, thus making the present embodiment ideally suited for an element substrate provided with many densely-disposed discharge ports for discharging a liquid. The potential of the protective layer 106 can be adjusted by selecting the heat-generating resistor layer 103 to be used as the connection wiring 108, without the need for adjusting the resistance values of the circuits formed on the element substrate.

Fifth Embodiment

In the present embodiment, a description will be given of an example of a liquid discharge head provided with the element substrate described in the first to the fourth embodiments.

FIG. 6A and FIG. 6B are perspective views illustrating a liquid discharge head 1 according to the present embodiment. More specifically, FIG. 6A is an exploded perspective view of the liquid discharge head, and FIG. 6B is a perspective view illustrating the liquid discharge head of FIG. 6A, the assembling of the components thereof having been completed. As illustrated in FIG. 6A and FIG. 6B, the liquid discharge head 1 according to the present embodiment has an element substrate 11, an electric wiring substrate 12, and a casing 13.

The element substrate 11 is any one of the element substrates described in the first to the fourth embodiments. The electric wiring substrate 12 has a plurality of lead terminals 14 electrically connected with the element substrate 11, and a plurality of terminals (not illustrated) connected with the electrode terminals of a recording apparatus in which the liquid discharge head is installed. The lead terminals 14 transmit drive signals or drive power for driving a driver 301 or a protective layer driver 401 to the element substrate 11.

The casing 13 is provided with a support section 15 that supports the element substrate 11. The support section 15 is formed of a recession, and the element substrate 11 is fixed to the bottom of the recession. Further, a junction surface 16 is provided, surrounding the opening edge of the recession of the support section 15, and the electric wiring substrate 12 is connected to the junction surface 16.

EXAMPLES

The following will describe examples of the present invention; however, the present invention is not limited thereto.

First Example

The element substrate according to the second embodiment illustrated in FIG. 3A to FIG. 3D was fabricated as described below.

First, the driver 301 and the voltage-dividing resistor 302 were formed on the base 101 in advance. As the voltage-dividing resistor 302, a diffusion resistor was used. The heat reserve layer 102 composed of SiO was deposited on the base 101 by a thermal oxidation method, a sputtering method, a CVD method or the like. Thereafter, a through-hole for connecting the circuit formed on the base 101 with the heat-generating resistor layer 103 and an electrode wiring layer 104 was formed by dry etching based on photolithography. The heat reserve layer 102 may be formed during the fabrication process of the driver 301.

Subsequently, the heat-generating resistor layer 103 made of TaSiN or the like was deposited to a thickness of approximately 50 nm on the heat reserve layer 102 by reactive sputtering, and an Al layer, which will turn into the electrode wiring layer 104, was deposited to a thickness of approximately 150 nm by sputtering. Then, the heat-generating resistor layer 103 and the electrode wiring layer 104 were simultaneously patterned by dry etching based on photolithography (reactive ion etching (RIE)).

Further, in order to form the heat-generating resistor element 107, the electrode wiring layer 104 was partially removed by wet etching based on photolithography thereby to expose the heat-generating resistor layer 103 at the removed part. At this time, a publicly known wet etching method is preferably used to obtain an appropriate tapered shape of the edge part of the electrode wiring layer 104 so as to ensure high coverage of the insulating layer 105 at the edge part of the electrode wiring layer 104.

Next, a SiN film was deposited to a thickness of approximately 150 nm as the insulating layer 105 by a plasma CVD method. Thereafter, a through-hole for providing the electrical contact between the protective layer 106 and the electrode wiring layer 104 was formed using dry etching based on photolithography. Thus, the insulating layer 105 was partially removed, and the electrode wiring layer 104 was exposed at the removed part.

After that, a Ta layer was deposited on the insulating layer 105 to a thickness of approximately 200 nm as the protective layer 106 by sputtering. Then, the protective layer 106 was partially removed by dry etching based on photolithography thereby to form the pattern of the protective layer 106 as illustrated in FIG. 1A. Next, the protective layer 106 was partially removed by dry etching based on photolithography to expose the electrode wiring layer 104 at the removed part so as to form a connection electrode for the connection with an external component.

In the present embodiment, the sheet resistance of the heat-generating resistor layer 103 and the shape of the heat-generating resistor element 107 were determined such that the resistance value of the heat-generating resistor element 107 is 500Ω. Meanwhile, the resistance values of voltage-dividing resistors 302*a* and 302*b* were set to 25 kΩ. Thus, the current flowing into a voltage-dividing resistor 302 was 1% of the current flowing into the heat-generating resistor element 107, making it possible to sufficiently suppress the fluctuation in the current flowing into the heat-generating resistor element 107.

A pulse voltage having a height of 24 V and a pulse width of 1.0 μs was applied to the heat-generating resistor element 107 of the element substrate fabricated as described above.

The film thickness of the insulating layer of the comparative example was approximately 300 nm. Applying the voltage to the heat-generating resistor element 107 described above reduces the voltage applied to the insulating layer 105 to approximately half the voltage in the comparative example. Hence, adequate insulation properties were obtained even when the film thickness of the insulating layer 105 was reduced to 150 nm, which is half the film thickness of the insulating layer 105 in the comparative example.

Second Example

In the present embodiment, an element substrate according to the third embodiment illustrated in FIG. 4A to FIG. 4E was fabricated.

Basically, the element substrate was fabricated in the same manner as the one described in the first example. The resistance values of the heat-generating resistor element 107 and the voltage-dividing resistor 302 are the same as those in the first example.

In the present example, when the supply voltage is 32 V, the current flowing through one voltage-dividing resistor 302 is 0.64 mA. In the present example, 128 groups, each of which consists of eight heat-generating resistor elements 107, were prepared, and the protective layer driver 401 was disposed for each group. In this case, the eight heat-generating resistor elements are driven by the single protective layer driver 401. This has reduced the maximum consumption current by 4.48 mA, as compared with the first example.

Third Example

In the present example, an element substrate according to the fourth embodiment illustrated in FIG. 5A to FIG. 5C was fabricated.

Basically, the element substrate was fabricated in the same manner as the one described in the first example. Unlike the first and the second examples, the present example does not have a newly added element, so that it was possible to fabricate an element substrate without the need for changing the size of a base 101 from a conventional one.

The illustrated configurations in the embodiments described above are merely examples, and the present invention is not limited thereto.

For example, the insulating layer 105 and the protective layer 106 may be shared by a plurality of the heat-generating resistor elements 107 in embodiments other than the third embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-048086, filed Mar. 11, 2015, which is hereby incorporated by reference herein in its entirety.

What is claimed is:

1. An element substrate comprising:

a base having a heat-generating resistor element which generates thermal energy used for discharging a liquid;

an electrically conductive protective layer covering the heat-generating resistor element; and an insulating layer provided between the heat-generating resistor element and the protective layer, the element substrate further comprising a potential applying unit for applying a potential to the protective layer such that a potential of the protective layer is lower than a potential at one end of the heat-generating resistor element and higher than a potential at the other end of the heat-generating resistor element with a voltage being applied between the one end and the other end of the heat-generating resistor element.

2. The element substrate according to claim 1, wherein the potential of the protective layer falls within a range of ±10% of a mean value obtained by averaging the potential at the one end of the heat-generating resistor element and the potential at the other end thereof.

3. The element substrate according to claim 1, further comprising a drive circuit which switches supply of current, wherein the potential applying unit is a generation circuit which generates the potential of the protective layer by using the current supplied from the drive circuit.

4. The element substrate according to claim 3, wherein:

the drive circuit has a MOS transistor, the MOS transistor, the generation circuit, and a ground wiring are connected in series in this order to a power source wiring through which power is supplied from an external source, and the generation circuit is connected to the protective layer.

5. The element substrate according to claim 4, wherein the MOS transistor is an nMOS transistor, a drain of which is grounded, or a pMOS transistor, a source of which is grounded.

6. The element substrate according to claim 4, wherein:

the MOS transistor, the heat-generating resistor element, and a ground wiring that is different from the ground wiring are connected in series in this order to the power source wiring, and a wiring branched from between the MOS transistor and the heat-generating resistor element is connected to the protective layer through the intermediary of the generation circuit.

7. The element substrate according to claim 4, further comprising a MOS transistor which is different from the MOS transistor and which switches the supply of current to the heat-generating resistor element.

8. The element substrate according to claim 1, further comprising, as the potential applying unit, a wiring connecting the heat-generating resistor element with the protective layer.

9. The element substrate according to claim 1, further comprising a plurality of the heat-generating resistor elements, wherein the protective layer covers the plurality of the heat-generating resistor elements and the insulating layer is provided between the plurality of the heat generating resistor elements and the protective layer.

10. The element substrate according to claim 1, further comprising:

a heat-generating resistor layer; and a first and a second electrode wirings which are provided in contact with the heat-generating resistor layer and which are spaced away from each other by a predetermined interval, wherein the heat-generating resistor element is a region between the first and the second electrode wirings in the heat-generating resistor layer, and the one end of the heat-generating resistor element is an end of the region on the side of the first electrode wiring, and the other end of the heat-generating resistor element is an end of the region on the side of the second electrode wiring.

11. An element substrate comprising:

a base having a heat-generating resistor element which generates thermal energy used for discharging a liquid;

an electrically conductive protective layer covering the heat-generating resistor element; and an insulating layer provided between the heat-generating resistor element and the protective layer, the element substrate further comprising a wiring which is connected to the protective layer and which causes a potential of the protective layer to take a value between a maximum potential and a minimum potential in the heat-generating resistor element with a voltage being applied to the heat-generating resistor element to discharge a liquid.

12. The element substrate according to claim 11, further comprising:

a heat-generating resistor layer; and a first and a second electrode wirings which are provided in contact with the heat-generating resistor layer and which are spaced away from each other by a predetermined interval, wherein the heat-generating resistor element is a region between the first and the second electrode wirings in the heat-generating resistor layer.

13. The element substrate according to claim 11, wherein a potential of the protective layer falls within a range of ±10% of a mean value obtained by averaging the maximum potential and the minimum potential of the heat-generating resistor element.

14. The element substrate according to claim 11, further comprising:

a drive circuit which switches supply of current; and a generation circuit which generates a potential of the protective layer by using the current supplied from the drive circuit, wherein the generation circuit and the protective layer are connected through the wiring.

* * * * *